US009980592B2

(12) United States Patent
Farentinos et al.

(10) Patent No.: US 9,980,592 B2
(45) Date of Patent: May 29, 2018

(54) COMPACT MAILBOX KIT

(71) Applicant: ARCHITECTURAL MAILBOXES, LLC, Redondo Beach, CA (US)

(72) Inventors: Christopher Andrew Farentinos, Redondo Beach, CA (US); Vanessa Felicia Troyer-Farentinos, Redondo Beach, CA (US); Craig Ronald Steele, Hawthorne, CA (US); Raffy Michael Arce Paje, Torrance, CA (US)

(73) Assignee: ARCHITECTURAL MAILBOXES, LLC, Redondo Beach, CA (US)

( * ) Notice: Subject to any disclaimer, the term of this patent is extended or adjusted under 35 U.S.C. 154(b) by 229 days.

(21) Appl. No.: 15/199,600

(22) Filed: Jun. 30, 2016

(65) Prior Publication Data

US 2017/0007059 A1 Jan. 12, 2017

Related U.S. Application Data

(60) Provisional application No. 62/190,557, filed on Jul. 9, 2015.

(51) Int. Cl.
*A47G 29/12* (2006.01)
*A47G 29/122* (2006.01)

(52) U.S. Cl.
CPC ..... *A47G 29/1209* (2013.01); *A47G 29/121* (2013.01); *A47G 29/1225* (2013.01); *A47G 2200/12* (2013.01)

(58) Field of Classification Search
CPC ..... A47G 29/1225; A47G 29/121; A47G 29/1209; A47G 2200/12; B65D 7/24; B65D 11/1873
USPC ..... 232/38, 17; 220/4.28, 6
See application file for complete search history.

(56) References Cited

U.S. PATENT DOCUMENTS

| | | | | |
|---|---|---|---|---|
| 4,275,829 | A * | 6/1981 | Johnson | A47G 29/1209 220/4.34 |
| 6,729,535 | B2 * | 5/2004 | Lackey | A47G 29/1209 232/17 |
| 6,817,080 | B1 * | 11/2004 | Lanyon | B21D 51/52 232/17 |
| 7,182,244 | B2 * | 2/2007 | Brown | A47G 29/1203 220/651 |
| 7,380,704 | B1 * | 6/2008 | Nizan | A47G 29/1209 232/17 |
| D727,589 | S * | 4/2015 | Amato | D99/29 |
| 2002/0190116 | A1 * | 12/2002 | Lackey | A47G 29/1209 232/17 |

* cited by examiner

*Primary Examiner* — William Miller
(74) *Attorney, Agent, or Firm* — Vista IP Law Group LLP

(57) ABSTRACT

A mailbox kit having a compact shipping volume and methods of assembling such mailbox are disclosed. The mailbox kit includes a roof having an arched shape and opposing elongated roof bottom edges forming the bottom of the arched shape and a mailbox floor positioned under the roof such that the floor and the roof form a compartment. A mailbox left sidewall and right sidewall are positioned within the compartment formed by the roof and the floor. A mailbox front door, handle and flag may also be positioned within the compartment. The mailbox components include lap joint flanges to attach the components of the kit to form an assembled mailbox.

16 Claims, 17 Drawing Sheets

| DIM | MIN | MAX | DIM | MIN | MAX |
|---|---|---|---|---|---|
| A | 6.25 | 11.00 | G | 6.00 | 15.00 |
| B | 4.50 | 8.25 | H | 1.00 | 2.12 |
| C | 3.12R | 5.50R | J | 1.00 | 2.00 |
| D | 18.56 | 22.81 | K | .50 | .87 |
| E | - | 2.00 | L | .87 | 1.25 |
| F | 3.75 | 8.50 | | | |

UNITS: INCHES

| DIM | MIN | MAX | DIM | MIN | MAX |
|---|---|---|---|---|---|
| A | 13.06 | 13.88 | G | ---- | 2.00 |
| B | 7.25 | 7.88 | H | 5.00 | ---- |
| C | 16.25 | 16.50 | J | 1.00 | 2.00 |
| D | 11.25 | 12.00 | K | .50 | .87 |
| E | 9.88 | 10.75 | L | 1.00 | 2.13 |
| F | R8 94 | R9 44 | M | .87 | 1.25 |

UNITS: INCHES

COMPACT MAILBOX KIT

CROSS-REFERENCE TO RELATED APPLICATIONS

This Application claims the benefit of U.S. provisional Application No. 62/190,557, filed on Jul. 9, 2015, in accordance with 35 U.S.C. Section 119(e), and any other applicable laws. The contents of the aforementioned application(s) are hereby incorporated herein by reference in their entirety as if set forth fully herein.

BACKGROUND

The field of the invention generally relates to mailboxes, and more specifically to a mailbox kit having a compact size in its unassembled state compared to its assembled state.

The onset and profound growth of online shopping and associated parcel shipping has driven notable changes in mailbox (also referred to herein as a "mail receptacle") design. There is growing demand for larger mailboxes that can accommodate larger mail volume and parcel delivery. Concurrently, freight charges incurred throughout the supply chain for bringing products to market have also increased dramatically, with demand often outpacing supply in ocean shipping and with upwardly trending fuel costs. In addition, larger mailboxes require more space during warehouse storage and retail display. As mail and parcel receptacles become larger and freight costs become a larger constituent of overall product cost, methods to reduce the physical volume of a mailbox during shipping, storage and retail display is beneficial.

In response to this growing demand for larger mailboxes, the United States Postal Service ("USPS") has issued a revision to their USPS Standard 7, from version B to version C. In USPS Standard 7C (Final Rule published in the Federal Register, Volume 80, Number 157), a new size of mailbox is presented, which is much larger than the previous standard and intended to receive most of the common USPS Flat Rate cartons. FIG. 1 shows a comparison of the previous standard mailbox size (the mailbox on the left in FIG. 1), which is still an approved size, and the new larger mailbox (the mailbox on the right in FIG. 1), which is now an additional approved size.

There are some unique constraints that must be considered when designing a mailbox to be sold as an unassembled kit for assembly by the consumer (i.e., a breakdown mailbox). All curbside mailboxes used in the U.S. today must undergo and pass testing against USPS Standard 7, and then be approved by the USPS Engineering Team. Several parts of Standard 7 aim to ensure the final product is large enough for typical deliveries, has the structural rigidity and strength to withstand abusive conditions sometimes experienced during use in the field, and is rainwater tight.

Section 4 of USPS Standard 7 (currently revision C) includes two requirements of particular interest, namely Section 4.8 (Structural Rigidity) and Section 4.9 (Impact Test). USPS Standard 7 identifies the static load and impact locations for these tests, describing how to perform them, and how to evaluate compliance. A paraphrased excerpt from USPS Standard 7 is provided below, with reference to FIG. 2:

1. Strength Test:

a. Apply the load amount shown in the table below at Position #1 onto bolster plate as shown in FIG. 2.

b. Hold for 1 minute.

c. Remove load.

d. Measure permanent deformation. Permanent deformation must not exceed the amount stated in the table.

e. Repeat for positions #2 through #5 using the load amounts shown in the table below.

| Position | Max. Deformation (inches) | Load (lbs) |
|---|---|---|
| 1 | ⅛ | 200 |
| 2 | ⅛ | 200 |
| 3 | ⅛ | 50 |
| 4 | ⅛ | 50 |
| 5 | ⅛ | 100 |

2. Impact Test:

a. Drop 10 lb weight onto position #3 from a height of 3 feet using a 2" x 2" bolster plate.

b. Observe closely inside and outside for any perforation (hole), crack, sharp edges, and door operation. There must not be any such perforations, cracks, or sharp edges, and the door must still operate normally.

c. Repeat for position #4.

Another section of USPS Standard 7 requires that no water intrude into the mail storage compartment during a specific water tightness test.

Accordingly, there is a need for a compact, mailbox kit which is easy to assemble, has a small unassembled size relative to the size of the assembled mail storage compartment, and meets the USPS standards.

SUMMARY

The present invention is directed to a compact mailbox kit for an unassembled mailbox which can preferably be easily assembled by the consumer, and has an assembled volumetric capacity for mail objects much greater than existing standard mailboxes (as shown in FIG. 1). The mailbox kit has an unassembled size which is significantly smaller than the assembled mailbox size, and in its assembled state, the mailbox preferably meets the USPS standards. Packaging, shipping, and storing the mailbox as an unassembled kit thus reduces the overall product size so as the product moves through the supply chain, the overall product cost may be reduced.

Accordingly, in one embodiment of the present invention, a mailbox kit includes an innovative configuration and arrangement of components which can be assembled into an assembled mailbox having a shipping volume (as used herein, the term "shipping volume" means the volume within the extremities of the relevant object) which is substantially smaller than the shipping volume of the same mailbox in an assembled state. The mailbox kit includes a roof configured to form the cover of the assembled mailbox. The roof has an arched shape and opposing elongated roof bottom edges forming the bottom of the arched shape. The mailbox kit has a floor configured to form a bottom of the assembled mailbox onto which mail inserted into the assemble mailbox is placed. The floor comprises a panel having opposing elongated floor sides extending along the length of the floor. In the mailbox kit, the floor is positioned under the roof such that the opposing elongated floor sides are adjacent and substantially parallel to respective roof bottom edges. In this arrangement, the floor and the roof form a compartment which is open at the front and rear sides.

The mailbox kit also includes a front door configured to form a front door of the assembled mailbox which can be pivoted between an open position and a closed position. The front door is also positioned within the compartment formed by the roof and the floor. The kit also has a left sidewall configured to form a left sidewall of the assembled mailbox, and a right sidewall configured to form a right sidewall of the assembled mailbox (opposing the left sidewall) positioned within the compartment formed by the roof and the floor. Each of the floor, roof, front door, left sidewall, and right sidewall are configured to be assembled to each other to form the assembled mailbox. For instance, these components may have joints, fastener holes, tabs, slots, and/or other assembly elements for connecting the components together to from the assembled mailbox.

In another aspect of the present invention, the front door, left sidewall and right sidewall are stacked on each other within the compartment. For instance, the front door may be stacked directly on the floor, then one of the left sidewall or right sidewall may be stacked directly on the front door, then the other of the left sidewall or right sidewall is stacked directly on the left sidewall or right sidewall which was stacked directly on the front door.

In still another aspect, the mailbox kit further includes a rear panel configured to form the rear panel of the assembled mailbox. The rear panel is positioned beneath the floor such that the floor is stacked directly on the rear panel.

In another aspect, the floor may include corresponding opposing floor flanges extending downward from each of the floor sides. The rear panel may then be nested within the floor side flanges.

In yet another aspect, the mailbox kit may also include an outgoing mail indicator flag configured to be rotatably attached to one of the left sidewall or right sidewall. The flag is also positioned within the compartment formed by the roof and the floor. For instance, the flag may be stacked directly on the topmost one of the left sidewall or the right sidewall. The mailbox kit may further include a handle configured to be attached to the front door for opening and closing the front door. The handle may be positioned within the compartment formed by the roof and the floor, such as adjacent to the flag.

In another aspect of the mailbox kit, the left sidewall and right sidewall may have lap joints in which one part has a lap joint groove into which an edge (i.e., a lap tongue) of the mating part slides into in order to attach the two parts together. This may be particularly useful in joining the sidewalls to the floor in order to prevent water from entering the mail compartment through the joint between the sidewalls and the floor. For example, the opposing floor flanges may have a lap joint groove with the groove opening facing upward. The bottom edge of the each of the left sidewall and right sidewall are configured to slide into the lap joint groove to form a lap joint between the floor and each of the right sidewall and left sidewall. The rear panel may also have a lap joint groove into which a rear edge of each of the sidewalls inserts to form a lap joint between the sidewalls and the rear panel. The lap joints may also be configured as double lap joints in which the insertion edge of the double lap joint is folded over to provide two layers of thickness. The lap joints create a tortuous path for water intrusion which helps prevent water from entering the mail compartment. The lap joints may also include weep holes spaced apart along the bottom of the joints to allow water to flow out of the joints, thereby preventing water from building up in the joints and leaking into the mail compartment.

In another aspect of the mailbox kit, one or more of the components can be injection-molded plastic parts. The components can be molded to produce tight lap joints between the components, and to provide contours, ridges and ribs to provide a path of least resistance for water to flow away from the mail storage compartment, and/or to increase the strength and/or rigidity of the assembled mailbox.

In another aspect of the mailbox kit, the roof is configured to overhang the sidewalls, the rear panel and the front door in the assembled mailbox. This helps prevent water from entering the mail compartment.

In an additional aspect, the joints between the floor, sidewalls, and roof may be reinforced using a rod or strap attached to the assembled mailbox that bridges the joints. Also, the components may include one-way assembly devices to prevent the components from being disconnected from each other. For example, the mating components may have mating tab and slot devices or one-way notches and tabs which engage to prevent assembled components from being disconnected. The devices engage easily when assembling the components, but are difficult to disengage once mated. This increases the structural integrity and rigidness of the assembled mailbox.

The components of the mailbox kit, such as the floor, sidewalls, rear panel, front door and roof may have ribbing to increase the strength and rigidity of the assembled mailbox. The components of the mailbox kit may also be "keyed" to guide the assembly of the components and to prevent mis-assembly. The components may also include "funneling" features to guide and align the components as they are being assembled into the finished mailbox. The various joint parts of the components may have audible or tactile feedback devices to indicate to the consumer when the respective components are fully assembled. For instance, the barbed tabs can be configured to make a snapping noise when the barbed tabs engage their respective mating engagement holes.

Another embodiment of the present invention is directed to a method of assembling the mailbox kit, as described herein. The left sidewall is attached to the left floor side edge, such that the left sidewall extends upward from the floor. The right sidewall is attached to the right floor side edge such that the right sidewall extends upward from the floor facing the left sidewall. The rear panel is attached to the left sidewall, the right sidewall and the floor. The roof is attached to the left sidewall, the right sidewall and the rear panel. The front door is hingedly attached to opposite sides of the floor, or to the right sidewall and left sidewall such that the front door is rotatable from a closed position to an open position. Thus, the method forms a fully assembled mailbox.

In another aspect of the method of assembling the mailbox kit, the mailbox kit also includes the flag, as described above. The flag is attached to one of the left sidewall or right sidewall such that the flag is rotatable between an up position and a down position.

In another aspect of the method of assembling the mailbox kit, the mailbox kit also includes the handle, as described above. The handle is attached to an outside of the front door.

The method of assembling the mailbox kit may also include any of the additional aspects and features described above for the mailbox kit. Moreover, the above-identified aspects and embodiments may be combined in various combinations as desired.

BRIEF DESCRIPTION OF THE DRAWINGS

The foregoing and other aspects of embodiments are described in further detail with reference to the accompanying drawings, wherein like reference numerals refer to like elements and the description for like elements shall be applicable for all described embodiments wherever relevant.

DETAILED DESCRIPTION

Figure 1:
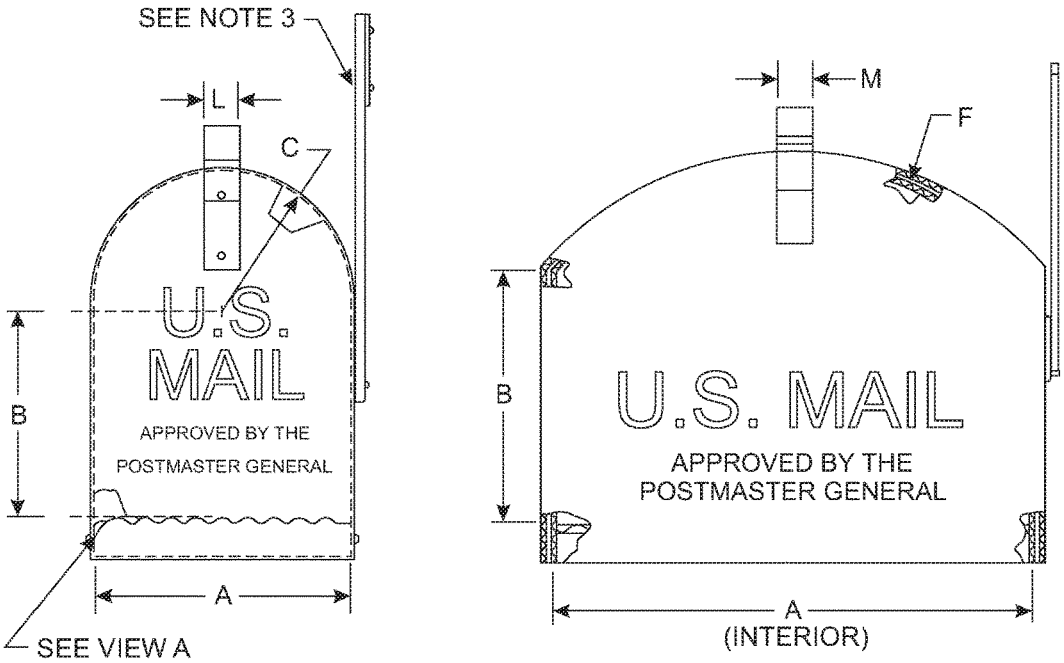
Fig. 1 Prior Art
FIG. 1 shows a comparison of a standard USPS mailbox design to a new, proposed larger capacity USPS mailbox design.
Figure 2:
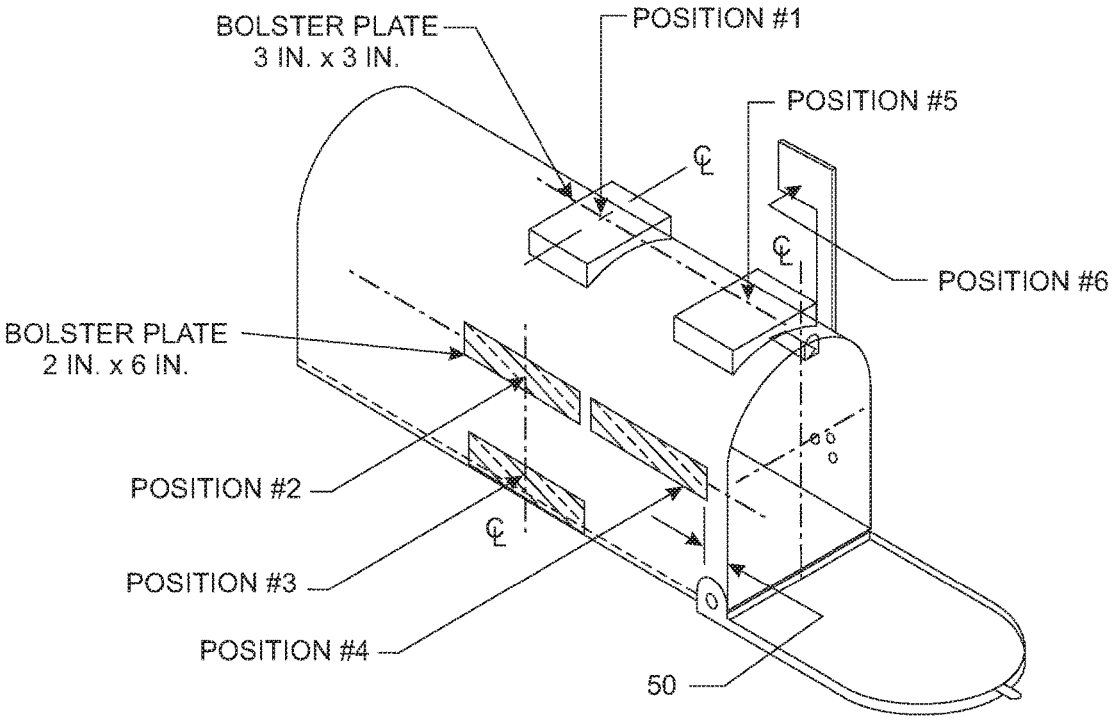
Fig. 2 Prior Art
FIG. 2 is an illustration representative of USPS Standard 7 showing a standard mailbox with position numbers and bolster plates identified for reference to testing under USPS Standard 7.
Figure 3:
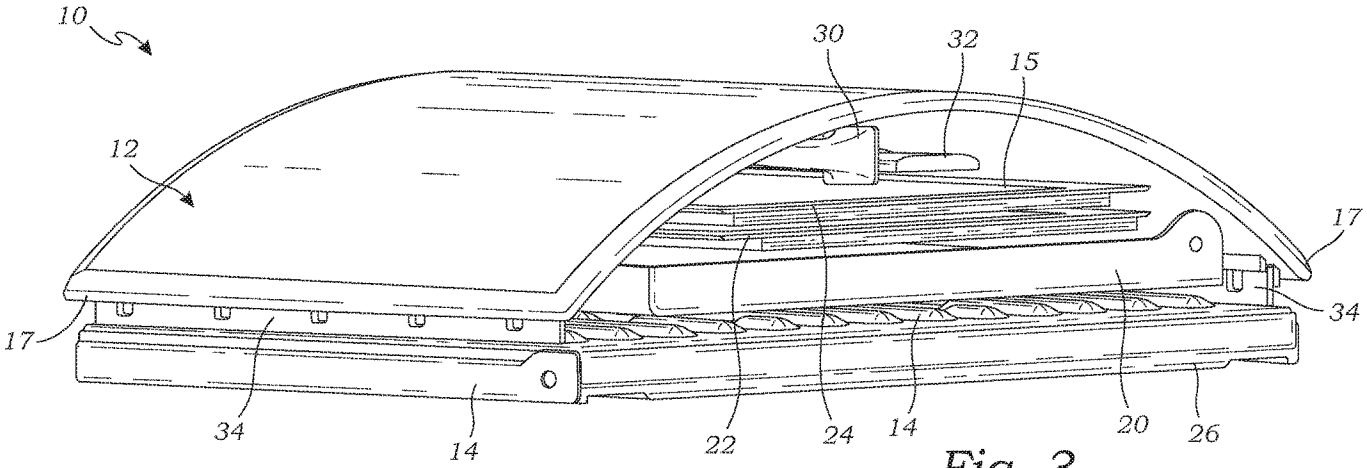
FIG. 3 is a front, perspective view of a compact mailbox kit, according to one embodiment of the present invention.
Figure 4:
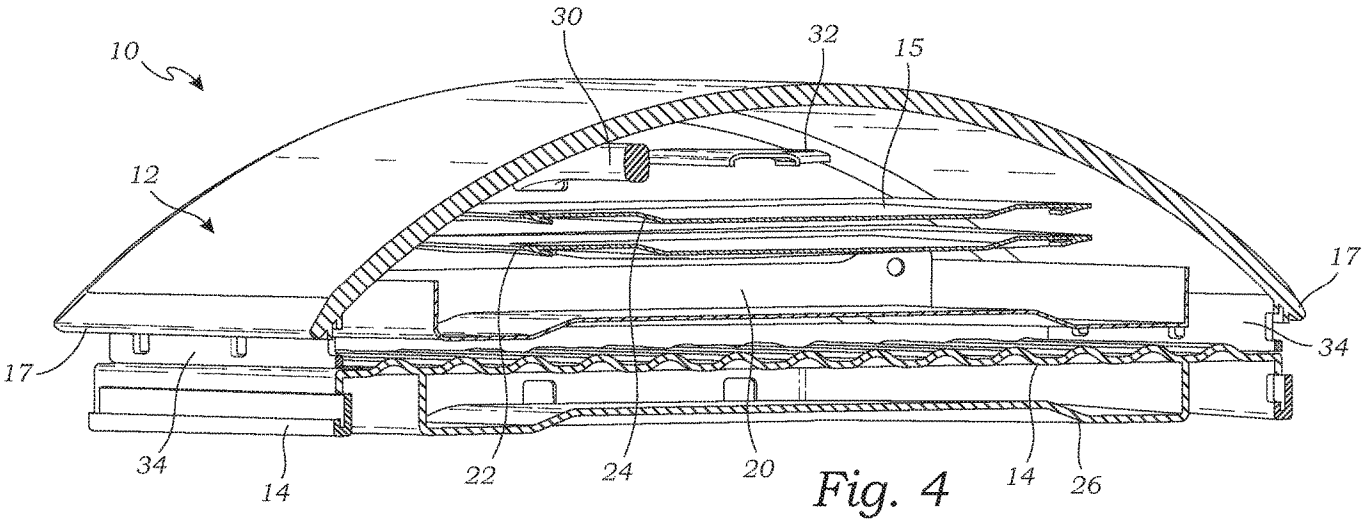
FIG. 4 is partial cut-away, perspective view of the compact mailbox kit of FIG. 3.
Figure 5:
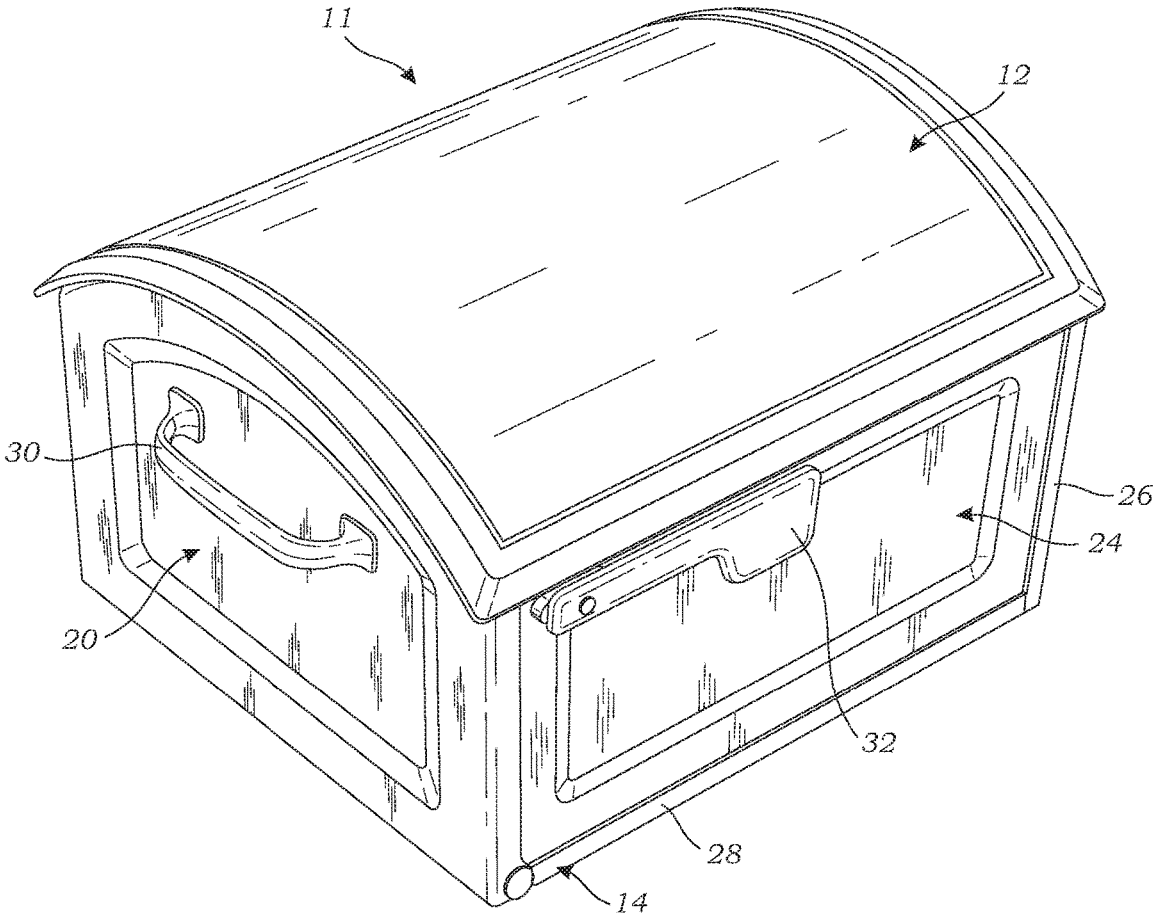
FIG. 5 is a side, perspective view of the compact mailbox kit of FIG. 3 after being assembled into a mailbox.
Figure 6:
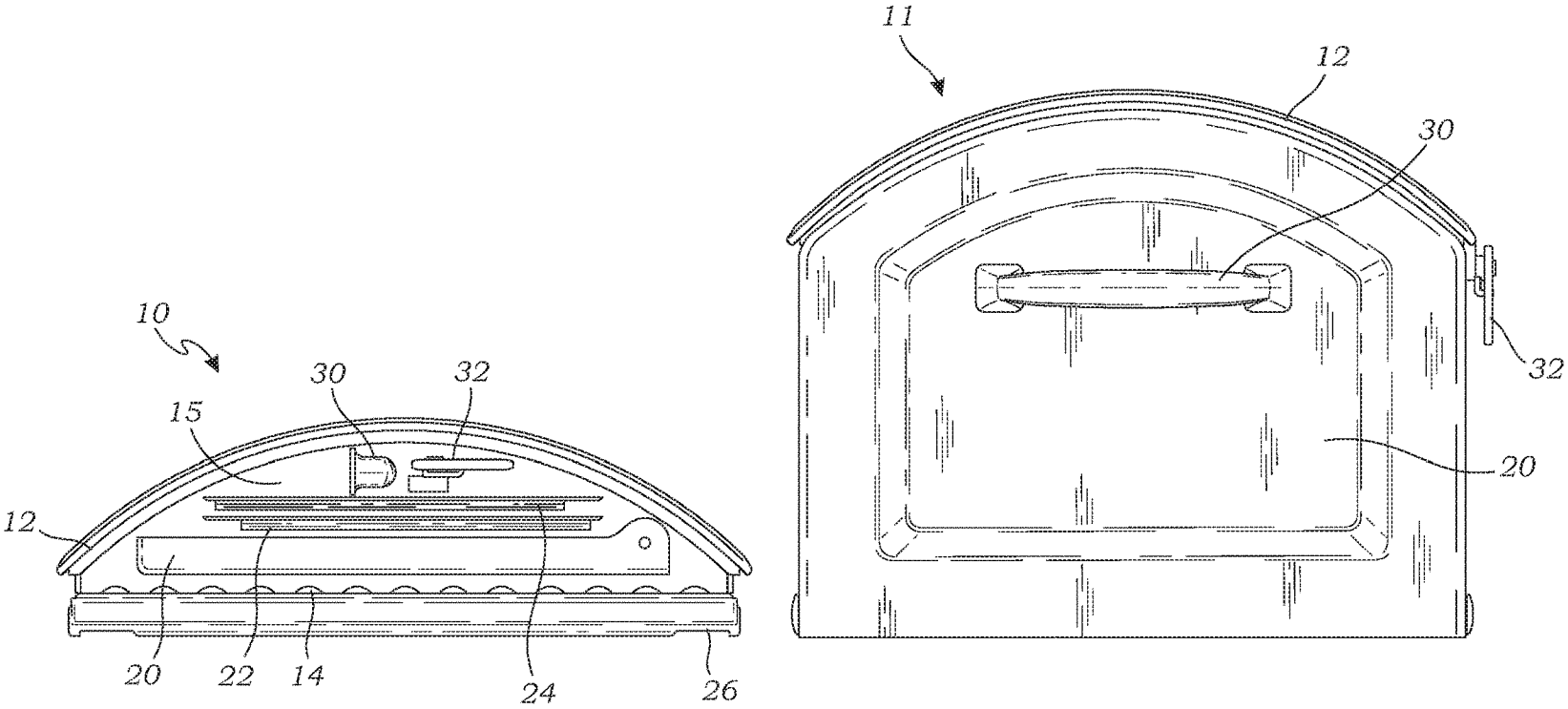
FIG. 6 is a front view illustrating a side-by-side comparison of the mailbox kit of FIG. 3 next to the assembled mailbox of FIG. 5.

Referring to FIGS. 3 and 4, one embodiment of a compact, unassembled mailbox kit 10 is shown which can be assembled into a large format mailbox 11 as shown in FIG. 5. As can be seen in the side-by-side comparison of FIG. 6, the mailbox kit 10 in its unassembled state has a significantly smaller shipping volume than the assembled mailbox 11. Although the drawings are not necessarily to scale, as illustrated in the side-by-side comparison of the mailbox kit 10 and the assembled mailbox 11 of FIG. 6, the shipping volume of the mailbox kit 10 is about one-third the shipping volume of the assembled mailbox 11.

Returning to FIGS. 3 and 4, the mailbox kit 10 comprises a roof 12 which forms the cover of the assembled mailbox 11. The roof 12 has an arched shape and opposing, elongated bottom edges 17 extending from the front of the roof 12 (at the front side of the mailbox 11) to the rear of the roof 12 (at the rear of the mailbox 11). The mailbox kit 10 also has a floor 14 which forms the floor of the assembled mailbox 11. The floor 14 has opposing, elongated floor sides 18 extending from the front of the mailbox 11 to the rear of the mailbox 11. The floor 14 is positioned under the roof 12 such that the roof 12 rests on the floor 14 with each of the roof bottom edges 17 adjacent and substantially parallel to a respective floor sides 18. In this stacked position, the roof 12 and the floor 14 form a compartment 15 which is open at the front side and rear side of the mailbox kit 10.

The mailbox kit 10 has a front door 20 which forms the front door 20 of the assembled mailbox 11. The front door 20 is stacked directly on the floor 14 such that the front door 20 is positioned within the compartment 15. The mailbox kit 10 also has a left sidewall 22 and a right sidewall 24 which form the left sidewall 22 and right sidewall 24 of the assembled mailbox 11. The left sidewall 22 and right sidewall 24 are stacked on each other and on the front door 20 such that the left sidewall 22 and right sidewall 24 are also positioned within the compartment 15. The front door 20, left sidewall 22 and right sidewall 24 may also be stacked on the floor 14 in any suitable order and arrangement, such as one of the left sidewall 22 or right sidewall 24 stacked directly on the floor 14 and the other of the left sidewall 22 or right sidewall 24 stacked thereon, and then the front door 20 stacked on the topmost sidewall 22 or 24, or the door 20 may be stacked between the sidewalls 22, 24.

The mailbox kit 10 also includes a rear panel 26 which forms the rear panel 26 of the assembled mailbox 11. The rear panel 26 is positioned beneath the floor 14 in the mailbox kit 10 such that the floor 14 is stacked directly on the rear panel 26. The floor sides 18 of the floor 14 may have floor flanges 28 (see FIGS. 9 and 10) extending downward from the flat panel 38 such that the rear panel 26 is nested within the floor flanges 28. Alternatively, the floor 14 may be inverted such that the floor flanges 28 are adjacent bottom edges 17 of the roof 12, which effectively makes the compartment 15 larger. The rear panel 26 may then be positioned adjacent the floor 14 within the compartment 15 or it may still be positioned beneath the floor 14.

The mailbox kit 10 has a handle 30 which is attachable to the front door 20 on the outside surface of the front door 20. The handle 30 is positioned within the compartment 15, such as being stacked on the topmost component of the stack which includes the front door 20, the left sidewall 22 and the right sidewall 24.

The mailbox kit 10 also has an outgoing mail indicator flag 32 which is rotatably attached to the left sidewall 22 or right sidewall 24 of the assembled mailbox 11. In the mailbox kit 10, the flag 32 is stacked on one of the components making up the stack which includes the front door 20, the left sidewall 22 and the right sidewall 24, and the handle 30.

Turning to FIGS. 7-21, each of the individual components will be described in further detail, including various elements provided to attach the components together into the assembled mailbox 11, to hold the parts together when assembled, and to prevent water from entering the mail compartment 32 of the assembled mailbox 11.

Figure 7:
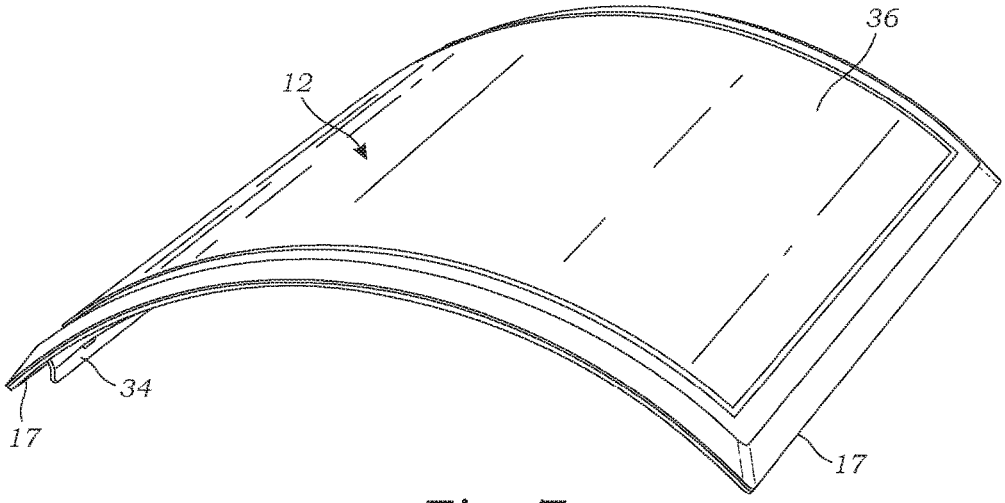
FIG. 7 is a perspective view of the top of the roof of the mailbox of FIGS. 3-5, according to one embodiment.
Figure 8:
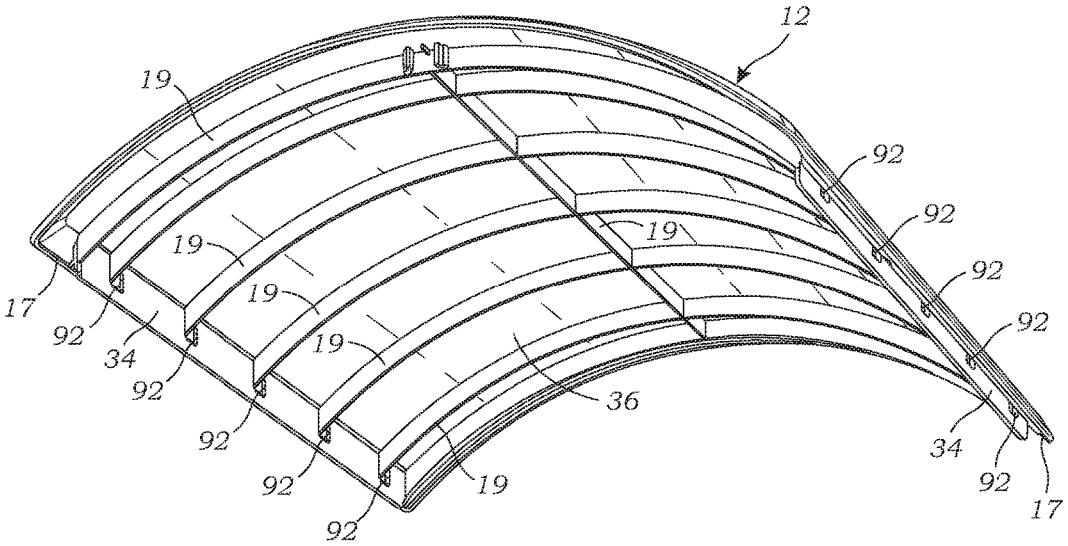
FIG. 8 is a perspective view of the bottom of the roof of the mailbox of FIGS. 3-5, according to one embodiment.

Referring to FIGS. 7 and 8, the roof 12 has an arched portion 36 and elongated bottom edges 17 on opposing sides of the arched portion 36, each of which extends from the front of the mailbox 11 to the rear of the mailbox 11. The roof 12 also has flanges 34 extending from each of the bottom edges 17. Each of the flanges 34 extends along the length of the respective bottom edge 14 from the front to the rear of the mailbox 11. Each of the flanges 34 has a plurality of fastening devices 92 spaced apart along the length of the flanges 34 for securing the roof 12 to the top edge of the respective left sidewall 22 and right sidewall 24. In this described embodiment, the fastening devices 92 comprise a plurality of slots 92 located along the flanges 34 which receive respective flexible tabs 94 disposed along the top edge 63 of the right sidewall 24 (see FIG. 14) and the top edge 63 of the left sidewall 22 (see FIG. 18). The mating tabs 94 and slots 92 form a one-way locking device 90. The tab 94 slides easily into the slot 92 during assembly, and once the tab 94 is in the slot 92, the tab 94 pops up into the slot 92 thereby locking the tab 94 into the slot 92 such that it is requires pushing the tab 94 down to remove the tab 94 from the slot 92. Each of fastening devices 92 and 94 described herein are configured and operate in this same manner. It is understood that the slot 92 and tab 94 arrangement may be reversed, and that each of the lap joint interfaces of the mailbox 11 may have one or more locking devices 90 to hold the components together in the assembled state. Furthermore, the locking devices 90 may be other suitable fastening systems, such as threaded holes for receiving screws or nuts and bolts, rivets, snaps, etc.

The roof 12 may also have a plurality of rib supports 19, some of which are transverse to the length of the roof and shaped to follow the contour of the arched portion 36 of the roof 12, and one or more extending lengthwise along the middle of the arched portion 36. As best shown in FIG. 5, the roof 12 overhangs the sidewalls 22 and 24, the front door 20 and the rear panel 26, such that water falling on the roof 12 runs off the edges of the roof 12 and onto the ground, instead of dripping down onto the sidewalls 22 and 24, the front door 20 and the rear panel 26. This improves the water tightness of the mailbox 11, and prevents water from entering the mail compartment 33.

Figure 9:
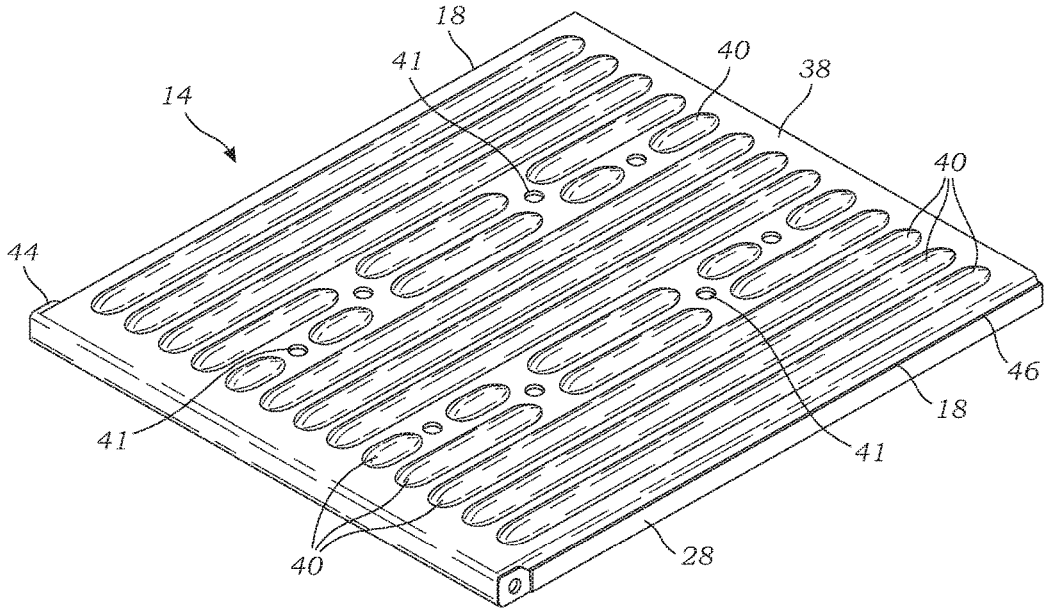
FIG. 9 is a perspective view of the top of the floor of the mailbox of FIGS. 3-5, according to one embodiment.
Figure 10:
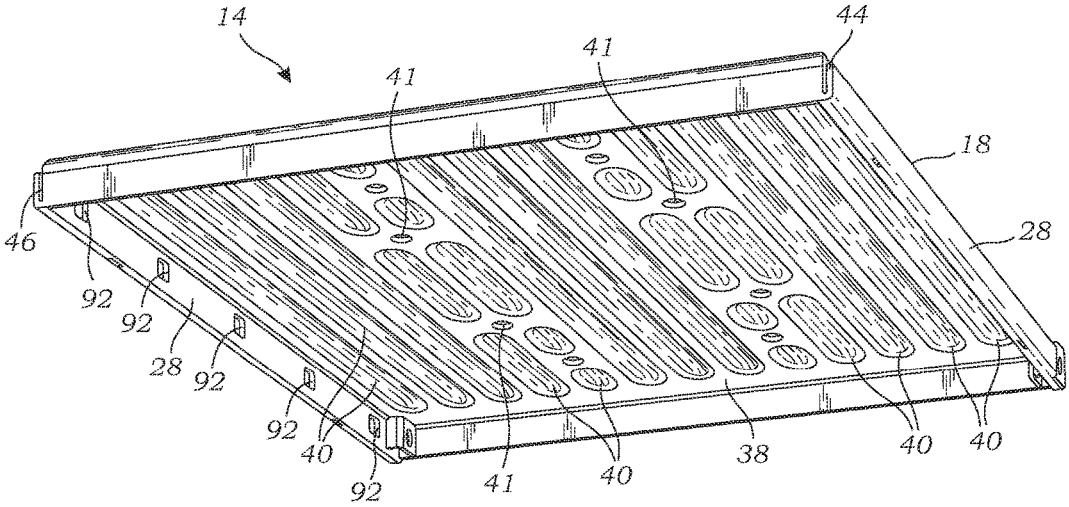
FIG. 10 is a perspective view of the bottom of the floor of the mailbox of FIGS. 3-5, according to one embodiment.

Turning to FIGS. 9 and 10, the floor 14 comprises a generally flat panel 38 which forms the floor of the mail compartment 33. The panel 38 has a plurality of ridges 40 extending longitudinally from the front of the floor 14 to the rear of the floor 14. The ridges 40 may be of different lengths, and/or separated to accommodate a plurality of drainage holes 41. The ridges 40 facilitate sliding mail into and out of the mail compartment 33, and also raise the mail above the flat panel 38 which prevents mail from getting wet in case there is moisture on the flat panel 38. The floor 14 also has opposing floor flanges 28 extending downward from respective floor sides 18, and extending along the length of the floor 14. The left floor flange 28 has a folded edge forming a lap joint groove 44 which faces upward and is open to the outer side of the floor 14, and the right floor flange 28 has a lap joint groove 46 (see enlarged view of FIG. 15) which faces upward and is open to the outer side of the floor 14. The lap joint grooves 44 and 46 receive the bottom edge 64 of a respective sidewall 22 and 24, as described below. The lap joint grooves 44 and 46 have fastening devices 92, same or similar to those described for the roof 12, which mate with tabs 94 along the bottom edge 64 of the sidewalls 22 and 24 for securing the sidewalls 22 and 24 to the lap joint grooves 44 and 46 of the floor 14.

Figure 12:
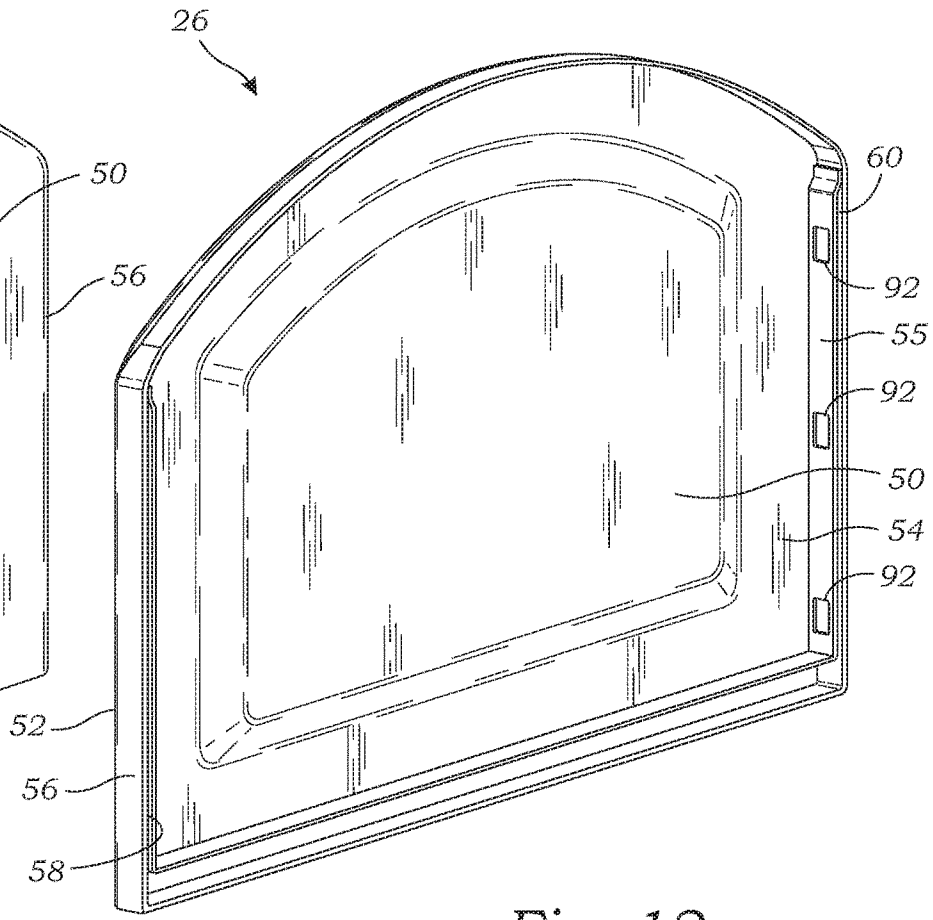
FIG. 12 is a perspective view of the interior of the rear panel of the mailbox of FIGS. 3-5, according to one embodiment.
Figure 11:
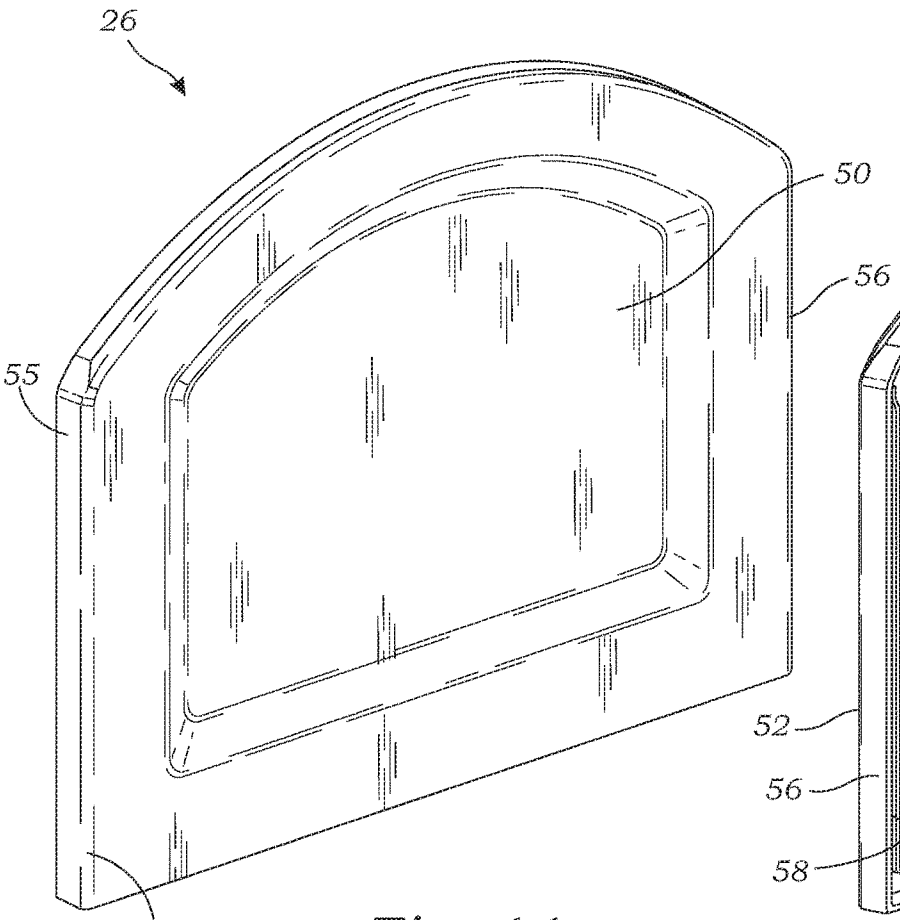
FIG. 11 is a perspective view of the exterior of the rear panel of the mailbox of FIGS. 3-5, according to one embodiment.
Figure 13:
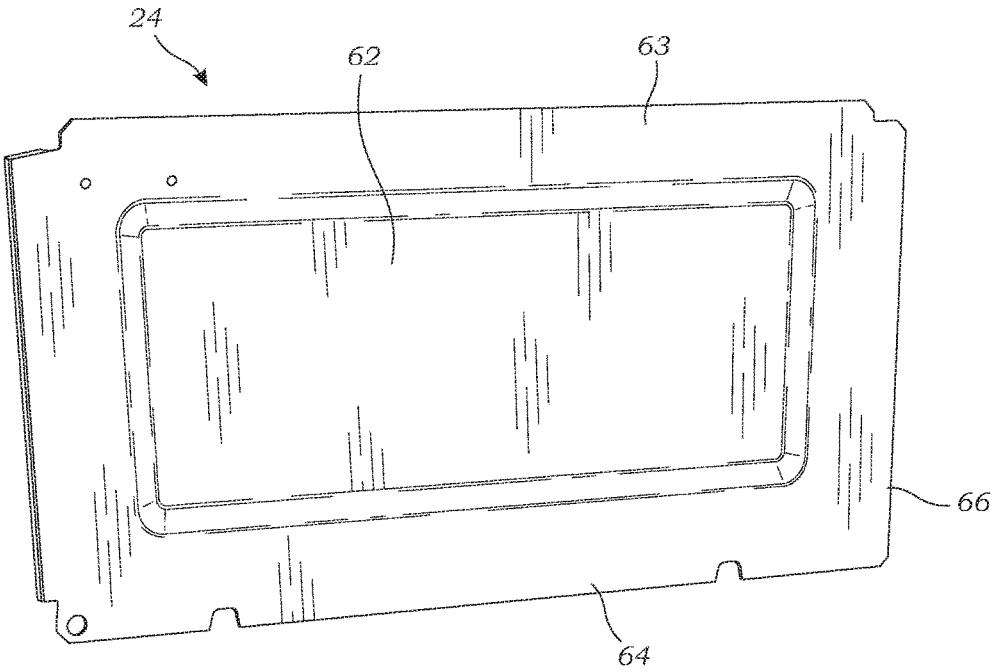
FIG. 13 is a perspective view of the exterior of the right sidewall of the mailbox of FIGS. 3-5, according to one embodiment.
Figure 14:
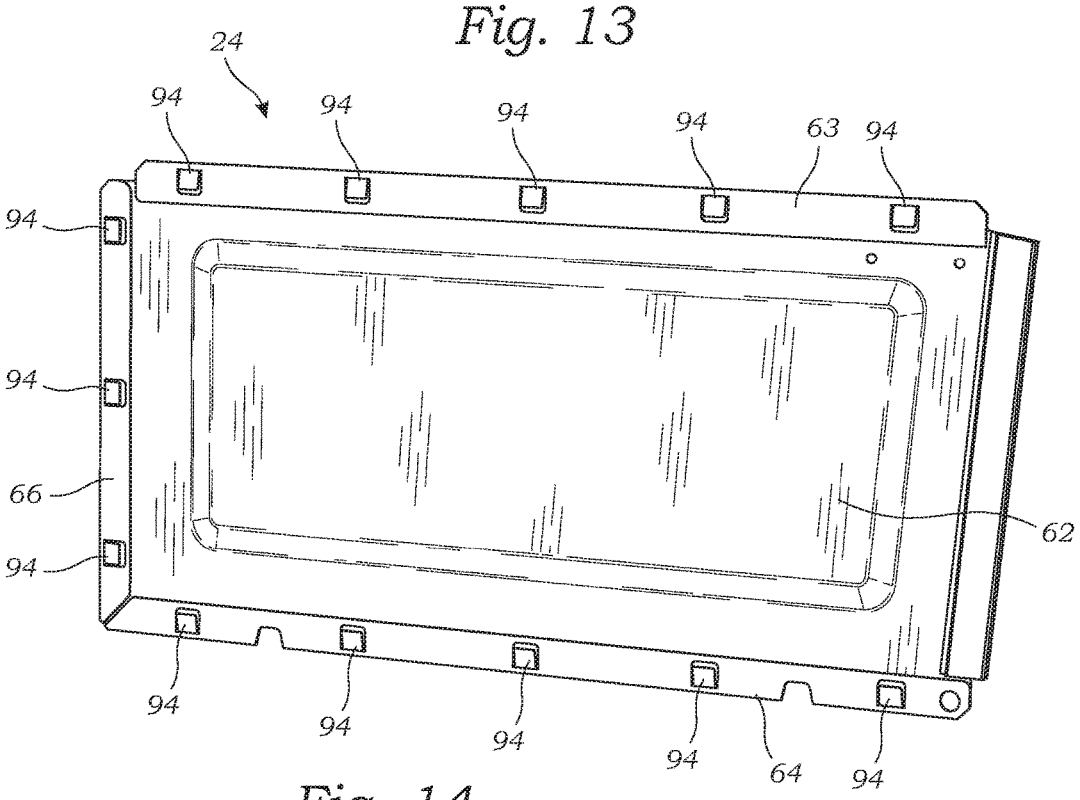
FIG. 14 is a perspective view of the interior of the right sidewall of the mailbox of FIGS. 3-5, according to one embodiment.
Figure 15:
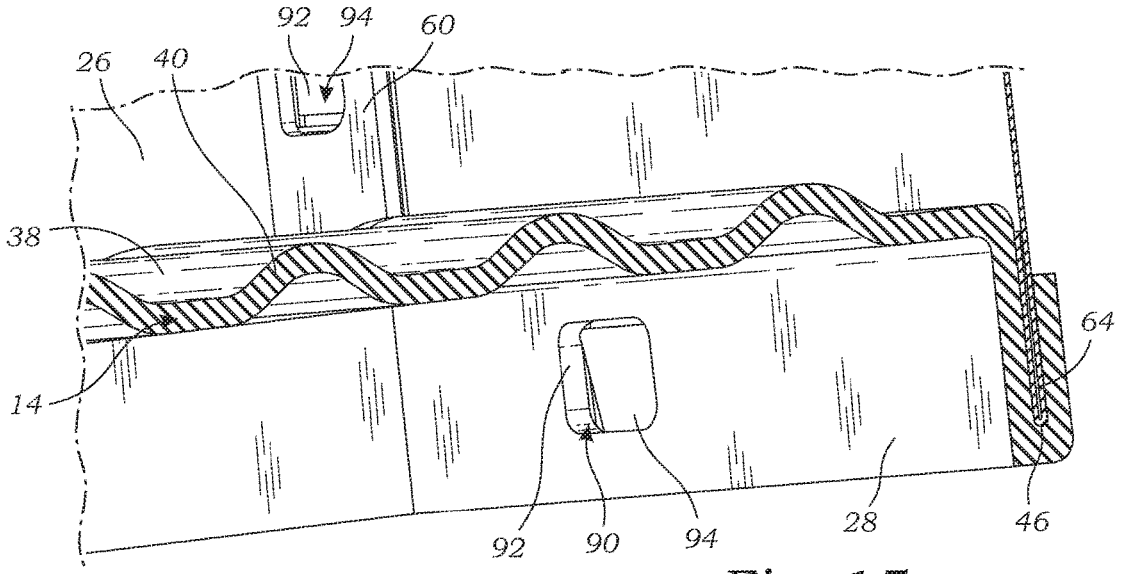
FIG. 15 is an enlarged, partial view of the assembled mailbox of FIG. 5, showing the connection between the floor and right sidewall and between the rear panel and the right sidewall.
Figure 16:
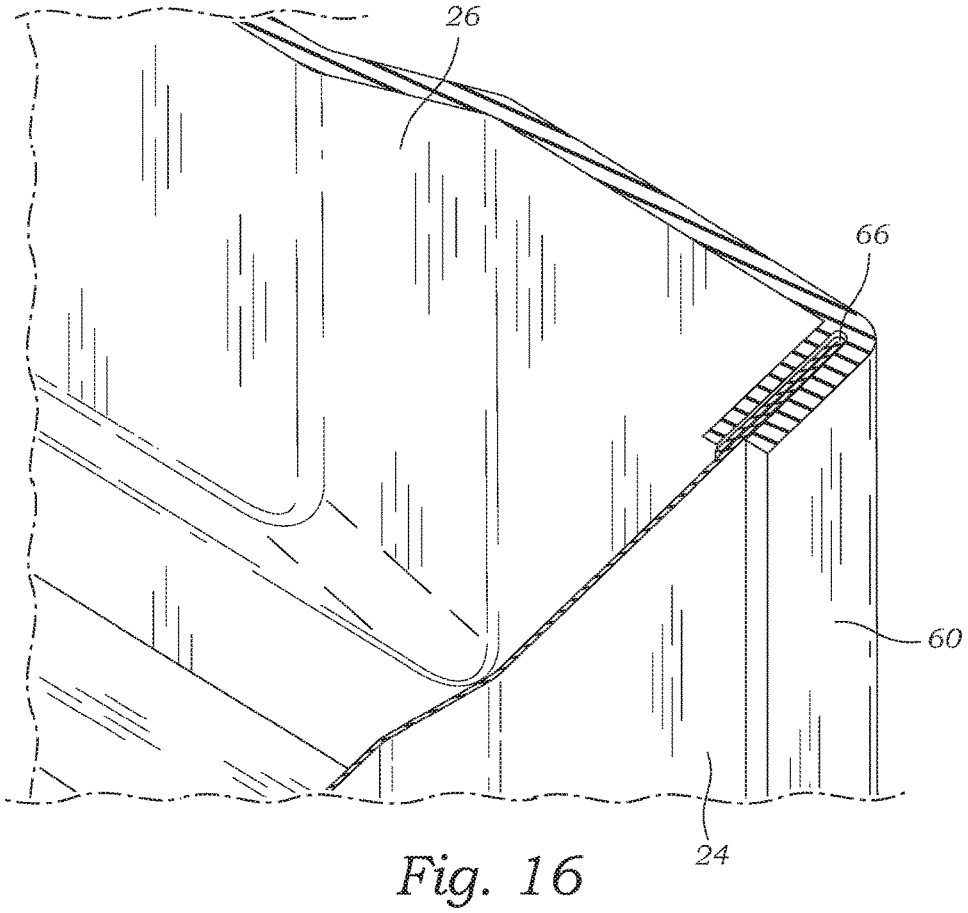
FIG. 16 is an enlarged, partial view of the assembled mailbox of FIG. 5, showing the connection between the rear panel and the right sidewall.

Turning now to FIGS. 11 and 12, the rear panel 26 comprises a generally flat panel 50 having a shape which matches a transverse cross-section of the mailbox 11. In other words, the panel 50 has a rectangular portion and an arched portion to match the contour of the arched portion of the roof 12. The rear panel 26 also has a left edge 52 and a right edge 54. The left edge 52 has a left flange 56 having a lap joint groove 58 extending forward from the panel 50 toward the front of the mailbox 11. The lap joint groove 58 receives a left sidewall rear edge 66 of the left sidewall 22. Similarly, the right edge 54 has a right flange 55 having a lap joint groove 60 extending forward from the flat panel 50 toward the front of the mailbox 11. The lap joint groove 60 receives a right sidewall rear edge 66 of the right sidewall 24. The lap joint grooves 58 and 60 have slots 92, same or similar to those described for the roof 12, which mate with tabs 94 along the rear edges 66 of the sidewalls 22 and 24 for securing the sidewalls 22 and 24 to the lap joint grooves 58 and 60 of the rear panel 26.

Referring now to FIGS. 13-16, the right sidewall 24 comprises a generally flat panel 62. The right sidewall 24 has a bottom edge 64 extending the length of the mailbox 11. The bottom edge 64 of the right sidewall 24 is configured to be received within the lap joint groove 46 of the right floor flange 28. The bottom edge 64 has a plurality of flexible tabs 94 spaced apart along the length of bottom edge 64 which mate with the slots 92 along the lap joint groove 46 of the right floor flange 28 to form fastening devices 90. As shown in the enlarged view of FIG. 15, the bottom edge 64 is received in the lap joint groove 46 of the right floor flange 28 such that the flexible tabs 94 mate with the slots 92. The bottom edge 64 may be folded over such that it has a double thickness of the panel 62 such that it will fit tightly, or even press fit, within the lap joint groove 46. The right sidewall 24 has a top edge 63 having a plurality of spaced apart flexible tabs 94 which mate with the slots 92 along the right flange 34 of the roof 12. The right sidewall 24 also has a right sidewall rear edge 66 which is adjacent the right edge 54 of the rear panel 26 in the assembled mailbox 11. The rear edge 66 also has spaced apart flexible tabs 94. As shown in the enlarged views of FIGS. 15 and 16, the rear edge 66 is received in the lap joint groove 60 of the rear panel 26 such that the flexible tabs 94 mate with the slots 92 of the lap joint groove 60. The rear edge 66 may be folded over such that it has a double thickness of the panel 62 such that it will fit tightly, or even press fit, within the lap joint groove 60. All of the edges of the components which are received within a lap joint groove may be folded over in this way.

Figure 17:
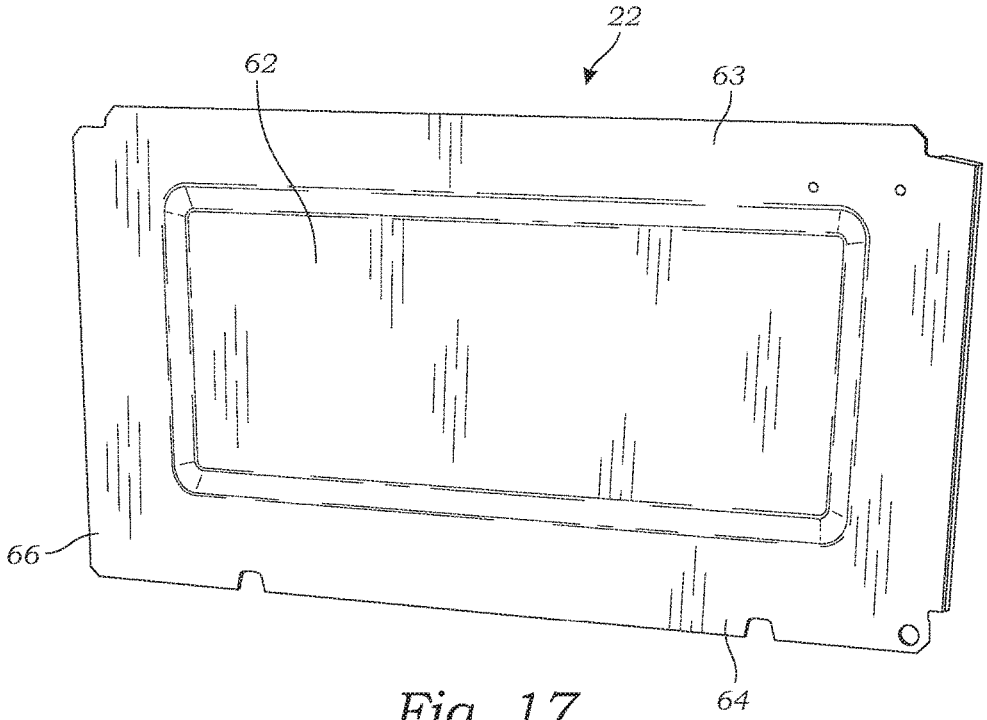
FIG. 17 is a perspective view of the exterior of the left sidewall of the mailbox of FIGS. 3-5, according to one embodiment.
Figure 18:
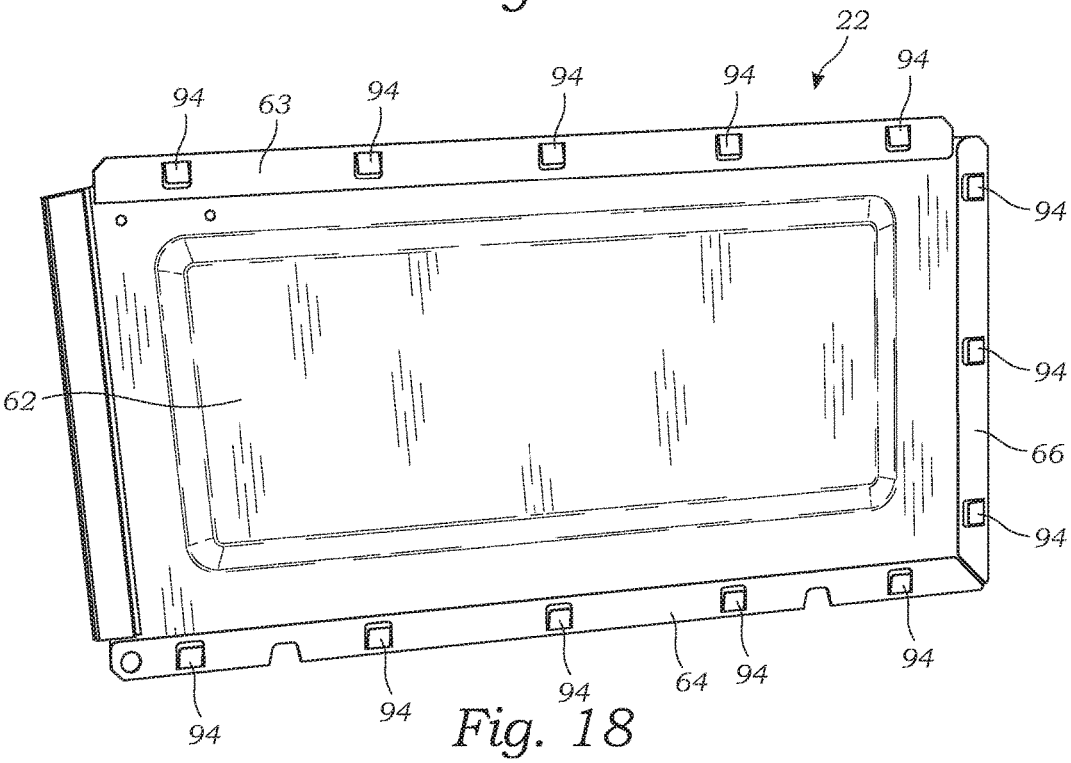
FIG. 18 is a perspective view of the interior of the left sidewall of the mailbox of FIGS. 3-5, according to one embodiment.

Referring now to FIGS. 17 and 18, the left sidewall 22 is a mirror image of the right sidewall 24, and also comprises a generally flat panel 62. The left sidewall 22 connects to the floor 14, roof 12 and rear panel 26 in the same manner as the right sidewall 24. The left sidewall 22 has a bottom edge 64 extending the length of the mailbox 11. The bottom edge 64 has a plurality of fastening devices comprising flexible tabs 94 spaced apart along the length of bottom edge 64 which mate with the slots 92 along the lap joint groove 44 of the left floor flange 28 to form fastening devices 90. The left sidewall 22 has a top edge 63 having a plurality of spaced apart flexible tabs 94 which mate with the slots 92 along the left flange 34 of the roof 12. The left sidewall 22 also has a rear edge 66 which is adjacent the left edge 52 of the rear panel 26 in the assembled mailbox 11. The rear edge 66 also has spaced apart flexible tabs 94. The rear edge 66 of the left sidewall 22 is received in the lap joint groove 58 of the rear panel 26 such that the flexible tabs 94 mate with the slots 92 of the lap joint groove 58.

Figure 20:
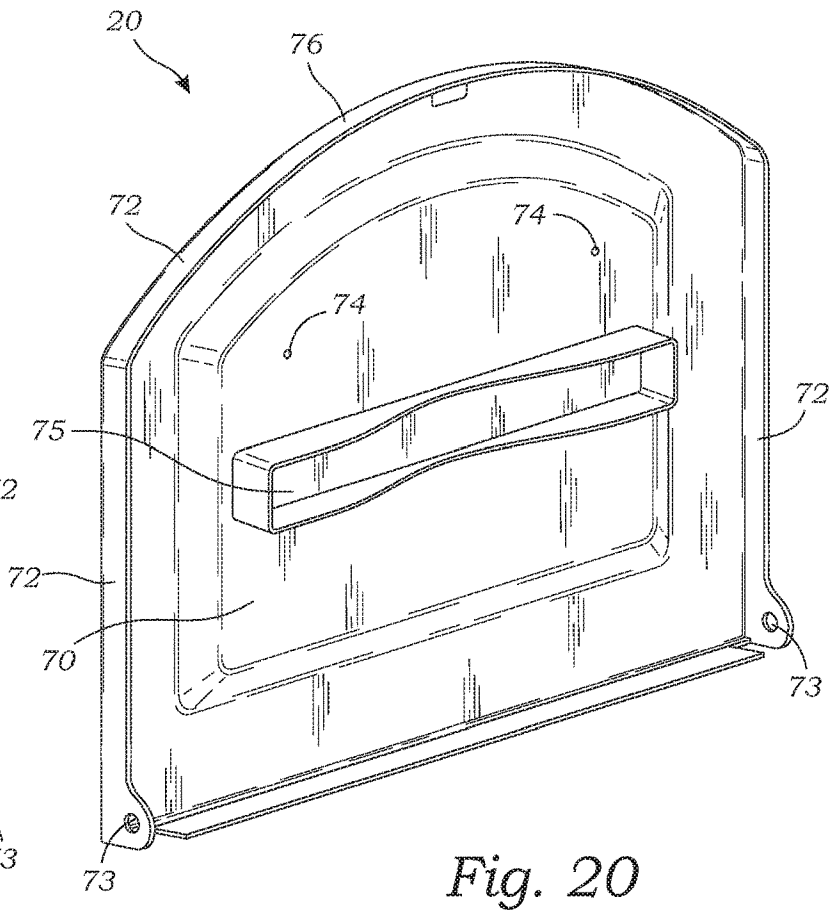
FIG. 20 is a perspective view of the interior of the front door of the mailbox of FIGS. 3-5, according to one embodiment.
Figure 19:
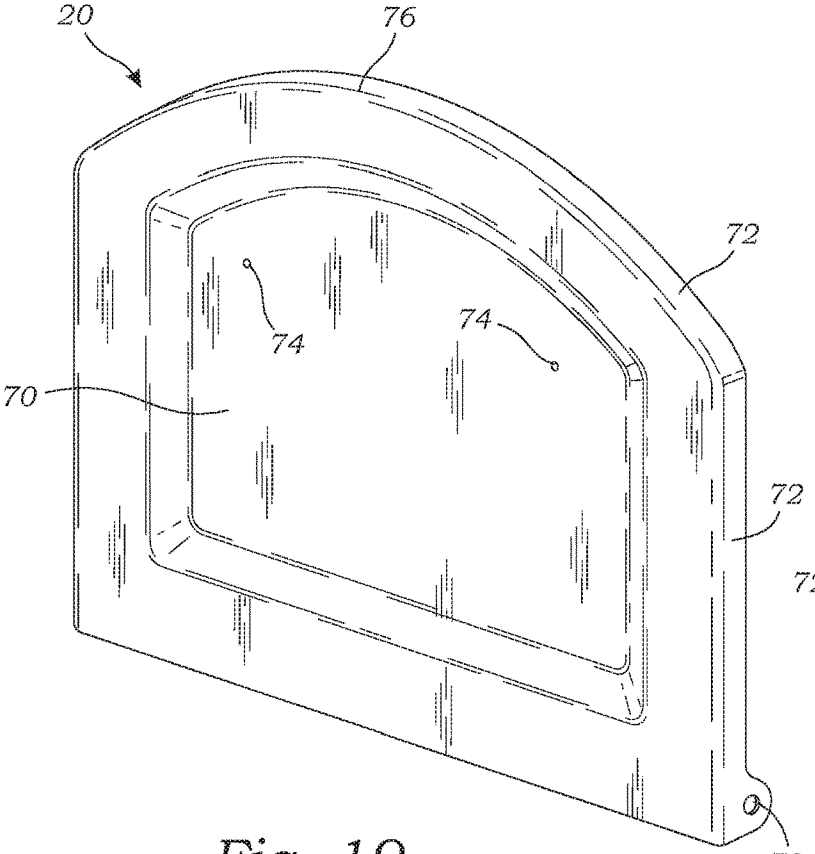
FIG. 19 is a perspective view of the exterior of the front door of the mailbox of FIGS. 3-5, according to one embodiment.

FIGS. 19 and 20 illustrate the front door 20 which generally comprises a flat panel 70 having a shape similar to the rear panel 26 described above. The front door 20 also has a door flange 72 extending backward from the side edges of the flat panel 70 and an arched top edge 76. The flange 72 is configured to overlap the sidewalls 22 and 24 when the front door 20 is closed, as shown in FIG. 5. The front door 20 has fastener holes 73 on opposing sides of the flange 72 for rotatably attaching the front door 20 to the mailbox 11. For example, the front door 20 may be rotatably attached to the sidewalls 22 and 24, and/or to the floor 14. The front door 20 also has fastener holes 74 for attaching the handle 30 to the outside of the front door 20. A reinforcing strap 75 or rod may be attached to the front door 20 and extending laterally across the panel 70 to increase the structural strength and rigidity of the mailbox 11. The strap 75 may also be vertically-oriented, diagonally-oriented, or oriented in another manner, and there may be more than one such strap 75.

Figure 21:
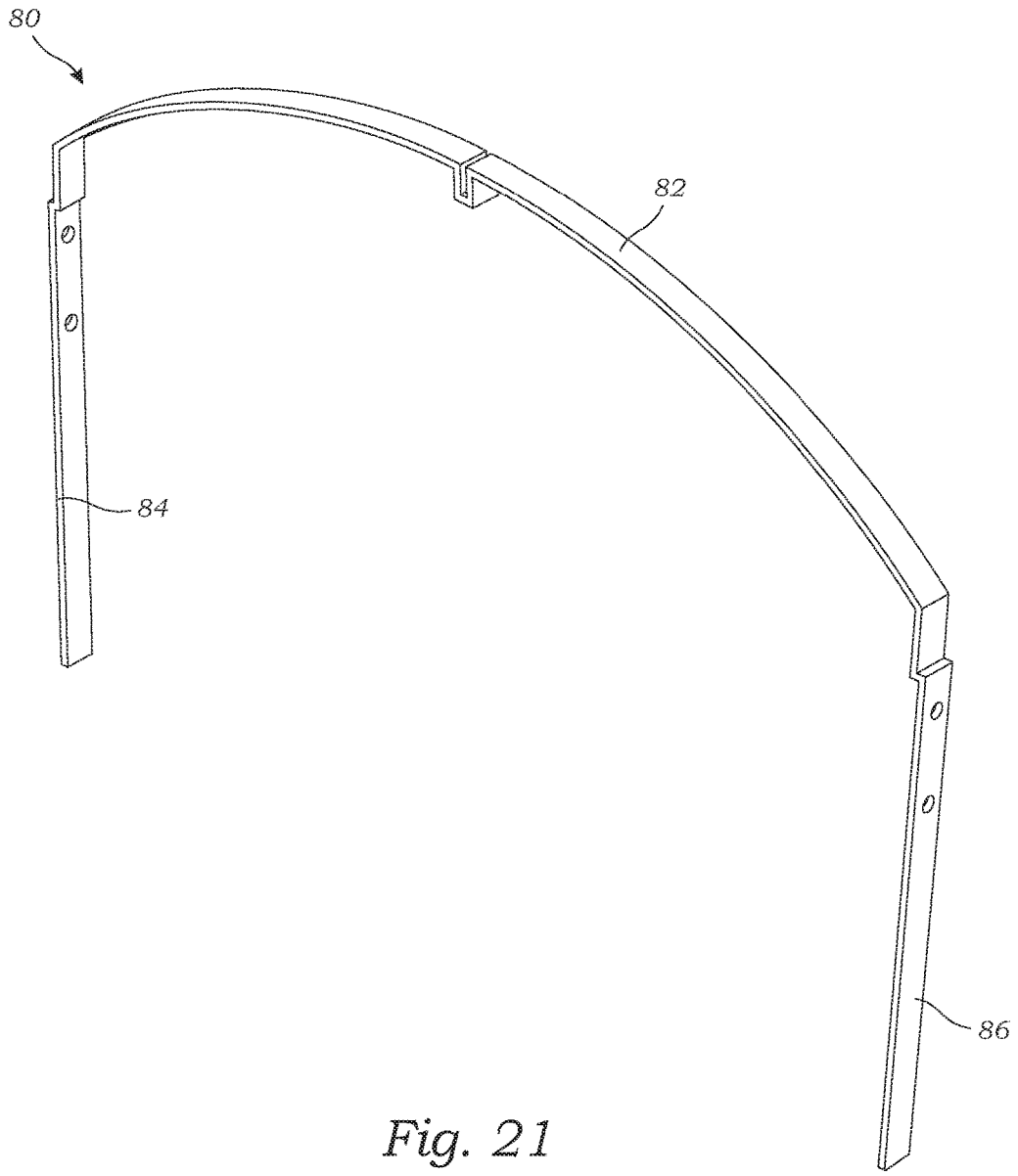
FIG. 21 is a perspective view of an exemplary reinforcing rod for reinforcing the mailbox of FIGS. 3-5, according to one embodiment.

The joints between the floor 14, sidewalls 22 and 24, and roof 12 may be reinforced using one or more rods and/or straps which bridge the joints between mating components of the assembled mailbox 11. For example, FIG. 21 shows a reinforcing rod 80 which can be inserted into the interior of the mailbox 11 and fits along the left sidewall 22, the right sidewall 24 and the roof 12 to reinforce the mailbox 11. The reinforcing rod 80 has an arched rod 82 which matches the arched portion 36 of the roof and a left upright 84 and right upright 86 which fit against left sidewall 22 and right sidewall 24, respectively. One or more reinforcing rods 80 may be utilized, such as one rod 80 at the front of the mailbox 11, one in the middle of the mailbox 11 and one at the rear of the mailbox 11. In addition, or alternatively, one or more L-shaped rods or straps may each have one side attached to one of a sidewall 22 or 24, the floor 14 and the rear panel 26, and the other side attached to another of the sidewall 22 or 24, the floor 14 and the rear panel 26 to reinforce the connection between the sidewalls 22 and 24, the floor 14, and the rear panel 26. Such reinforcements also increase the rigidity and overall strength of the assembled mailbox 11.

The components of the mailbox kit 10, including the roof 12, floor 14, sidewalls 22 and 24, rear panel 26, and front door 20 may also include ribbing (e.g., see ribs 19 of the roof 12) to increase the strength and rigidity of the assembled mailbox 11. These components or their subcomponents may also be "keyed" and/or provided with lead-ins to guide the assembly of the components and to prevent mis-assembly. The components may also include "funneling" features, such as tapered features, guides, etc., to guide and align the components as they are being assembled into the assembled mailbox 11. The lap joints may also have audible or tactile feedback devices to indicate to the user when the respective components are fully assembled. For instance, the tabs 94 of the locking device 90 can be configured to make a snapping noise when the tabs 94 engage the respective slots 92.

Figure 22:
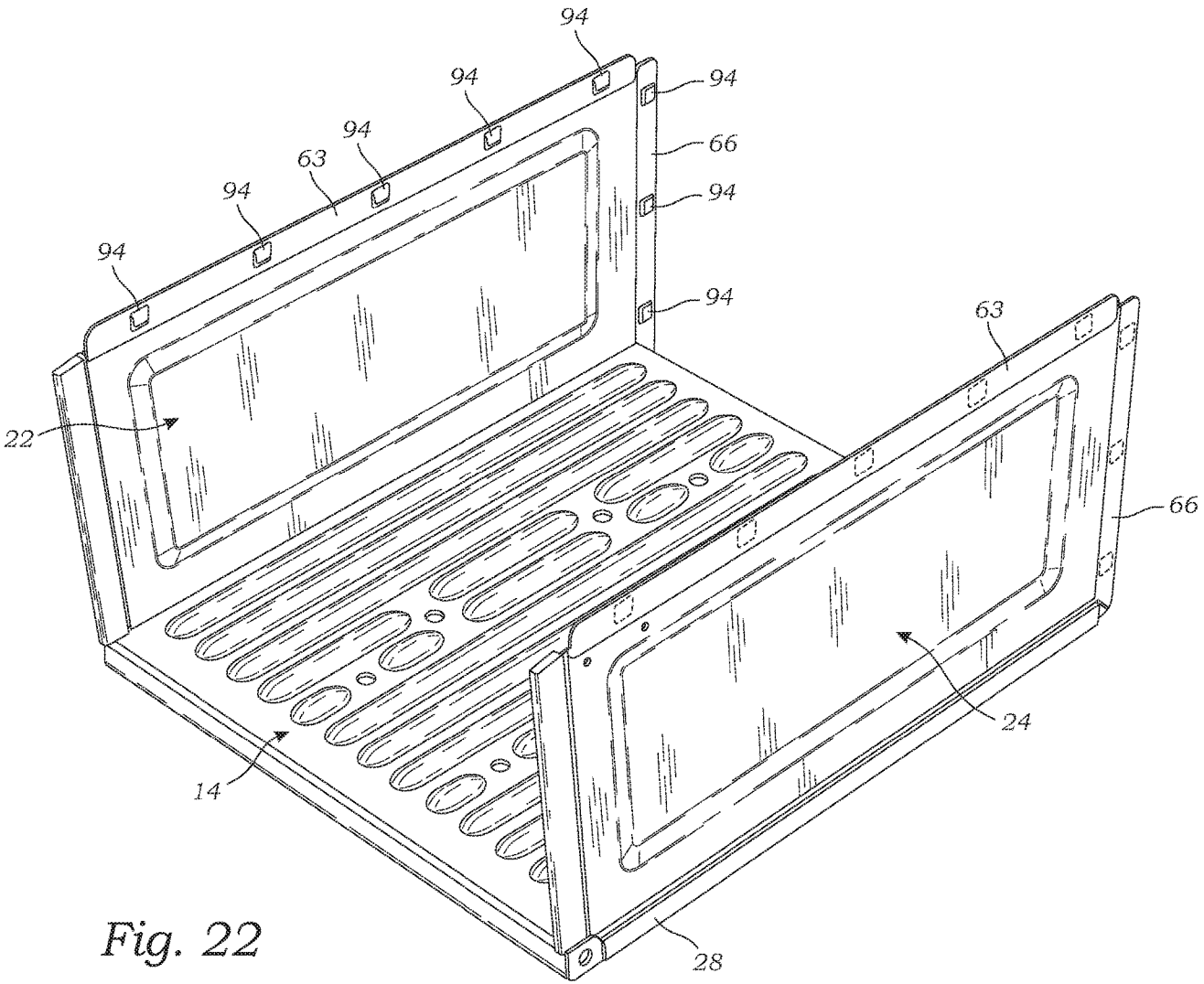
FIGS. 22-25 are perspective views showing the assembly of the mailbox kit of FIGS. 3 and 4 into the assembled mailbox of FIG. 5, according to one embodiment.
Figure 23:
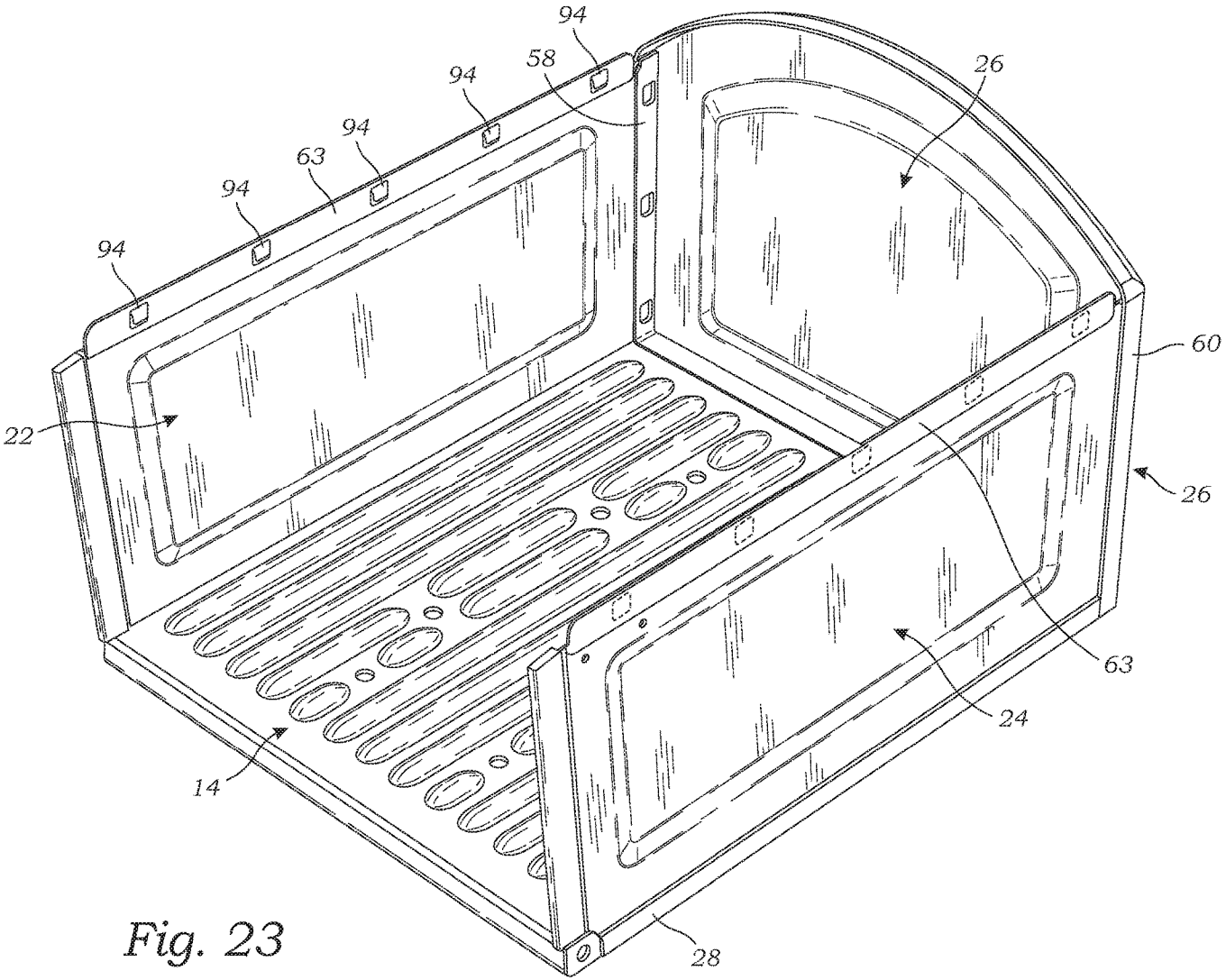
Figure 24:
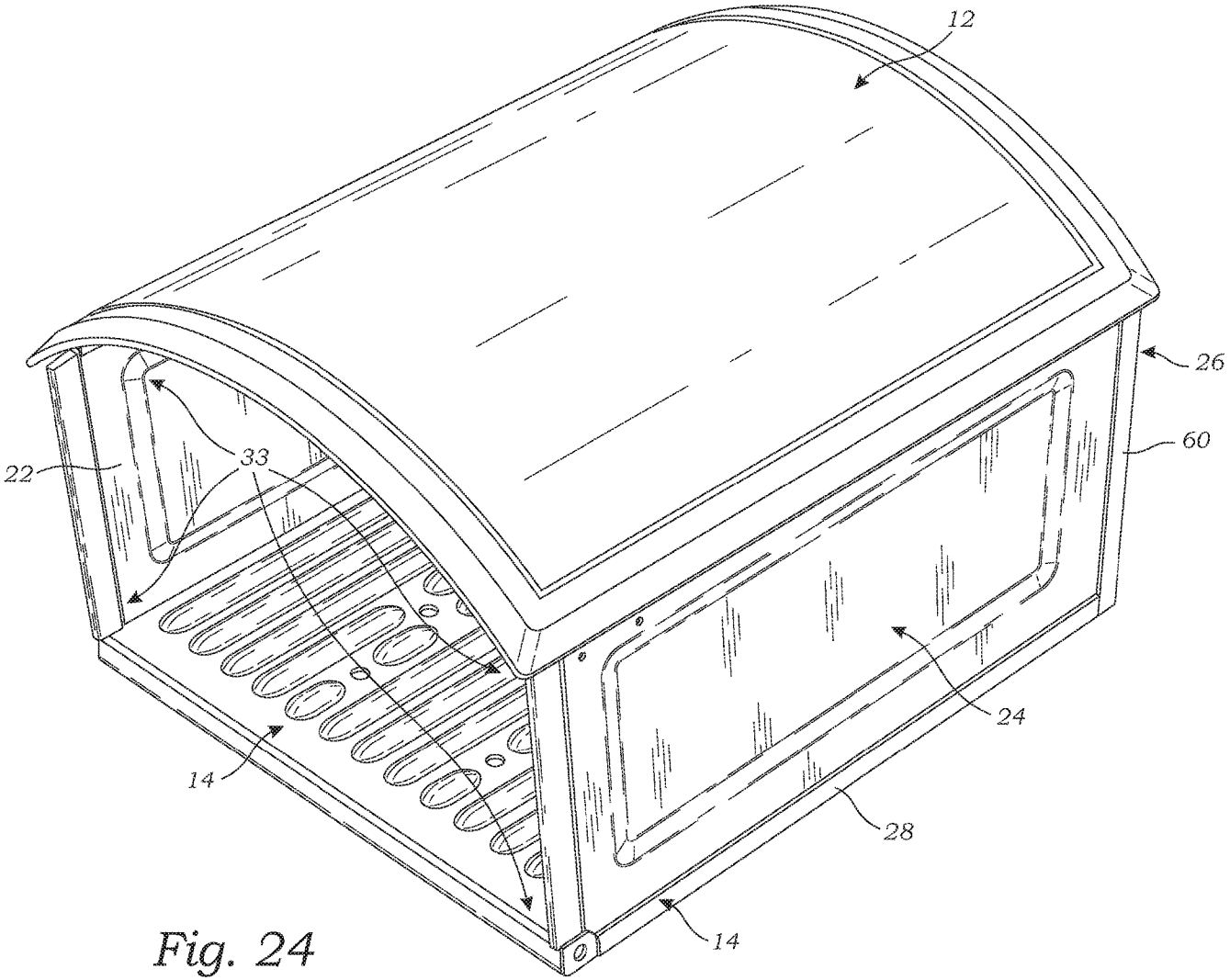

Referring to FIGS. 5 and 22-25, the assembly of the mailbox kit 10 into the assembled mailbox 11 will now be described. As shown in FIG. 22, starting with the floor 14, the right sidewall 24 is attached to the floor 14 by sliding the bottom edge 64 into the lap joint groove 46 of the right floor flange 28. The left sidewall 22 is attached to the floor 14 by sliding the bottom edge 64 into the lap joint groove 44 of the left floor flange 28. If locking devices 90 are utilized, the tabs 94 lock into the respective slots 92 thereby locking the connection of the sidewalls 22 and 24 to the floor 14. Turning to FIG. 23, the rear panel 26 is attached to the sidewalls 22 and 24 by sliding the lap joint groove 58 onto the rear edge 68 of the left sidewall 22 while also sliding the lap joint groove 60 onto the rear edge 66 of the right sidewall 24. Again, if locking devices 90 are utilized, the tabs 94 lock into the respective slots 92 thereby locking the connection of the rear panel 26 to the sidewalls 22 and 24. Referring to FIG. 24, the roof 12 is attached to the assembly by placing the roof 12 onto the top edges 63 of the sidewalls 22 and 24 and the top edge of the rear panel 26 and securing the roof 12 to the sidewalls 22 and 24, such as by attaching the flanges 34 to the respective top edges 63 of the sidewalls 22 and 24. For example, if the locking devices 90 are utilized, the tabs 94 lock into the respective slots 92 thereby locking the connection of the roof 12 to the sidewalls 22 and 24. It is to be understood that other types of fasteners may be utilized, to provide one or more of the connections between the components of the mailbox kit 11, as described herein.

Figure 25:
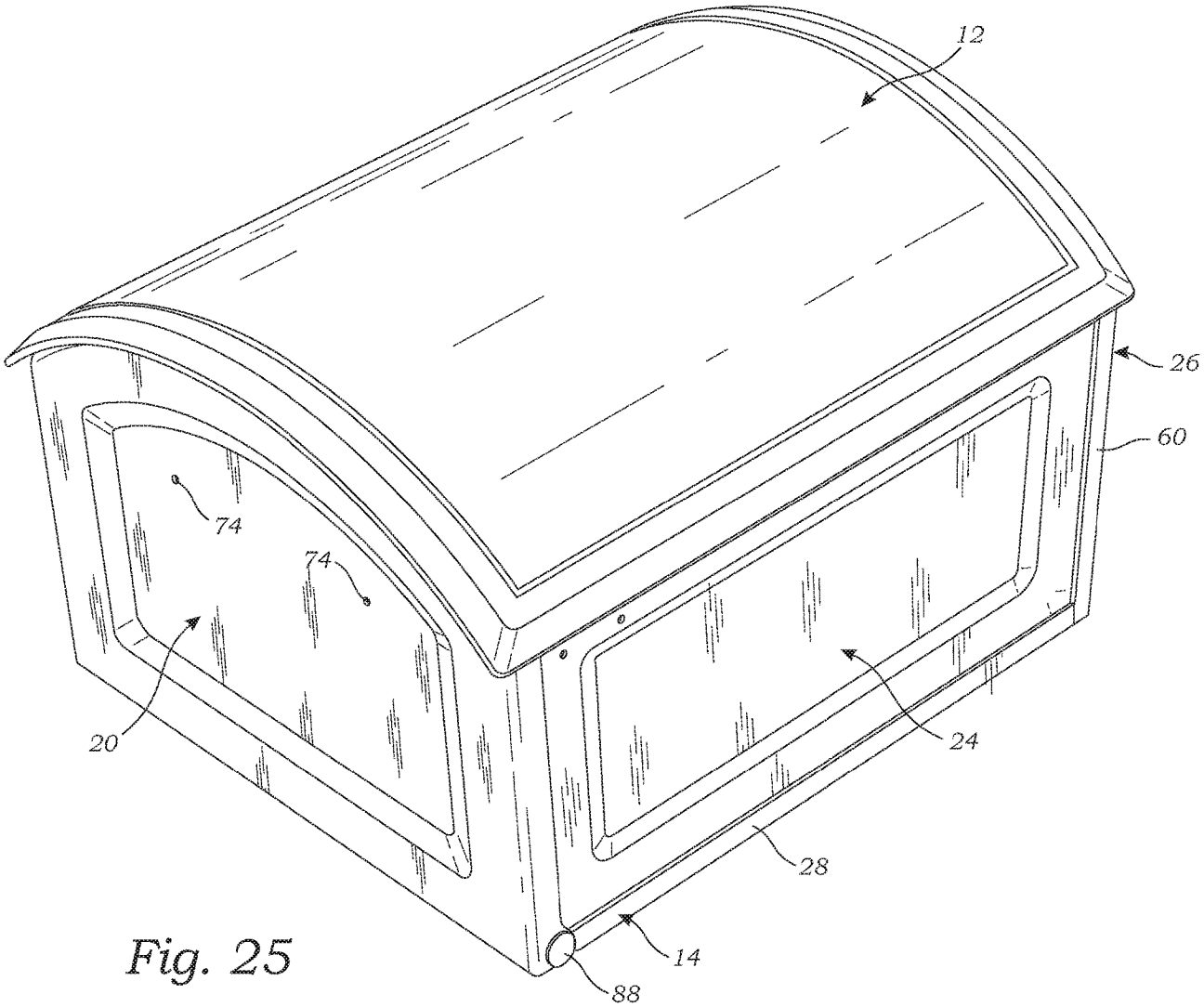

Turning to FIG. 25, the front door 20 is installed by rotatably attaching the front door 20 to the sidewalls 22 and 24 using fasteners 88 inserted through the fastener holes 73 on the opposing sides of the flange 72, and through the aligned holes in the floor 14. Referring back to FIG. 5, the handle 30 is attached to the front door 20 by inserting screws through the fastener holes 74 in the front door 20 and screwing the screws into the threaded holes in the handle 30. The mail indicator flag 32 is rotatably attached to the right sidewall 24 using a rod and suitable fasteners. Of course, the order of assembling the components of the mailbox kit 10 into the assembled mailbox 11 is not limited to the order as described, but may be performed in any other suitable sequence. For instance, the handle 30 can be attached to the front door 20 before installing the front door 20, the sidewalls 22 and 24 can be attached to the rear panel 26 before attaching the floor 14, etc.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

What is claimed is:

1. A mailbox kit configured to be assembled into an assembled mailbox, comprising:

a roof configured to form a cover of the assembled mailbox, the roof having an arched shape and opposing elongated roof bottom edges forming a bottom of the arched shape;

a floor configured to form a bottom of the assembled mailbox, the floor comprising a panel having opposing elongated floor sides, each of the floor sides having corresponding opposing floor flanges extended downward from the panel, the floor positioned under the roof such that the opposing elongated floor sides are adjacent and substantially parallel to respective roof bottom edges, whereby the floor and the roof form a compartment;

a left sidewall configured to form a left sidewall of the assembled mailbox, the left sidewall positioned within the compartment formed by the roof and the floor;

a right sidewall configured to form a right sidewall of the assembled mailbox, the right sidewall positioned within the compartment formed by the roof and the floor; and a front door configured to form a front door of the assembled mailbox which can be pivoted between an open position and a closed position, the front door positioned within the compartment formed by the roof and the floor.

2. The mailbox kit of claim 1, wherein the front door, left sidewall and right sidewall are stacked on each other within the compartment.

3. The mailbox kit of claim 1, further comprising a rear panel configured to form a rear panel of the assembled mailbox, the rear panel positioned adjacent the floor and nested within the floor side flanges.

4. The mailbox kit of claim 3, wherein the front door, left sidewall and right sidewall are stacked on each other within the compartment.

5. The mailbox kit of claim 4, further comprising:

a flag configured to be rotatably attached to one of the left sidewall or right sidewall, the flag positioned within the compartment formed by the roof and the floor.

6. The mailbox kit of claim 5, further comprising:

a handle configured to be attached to the front door, the handle positioned within the compartment formed by the roof and the floor.

7. The mailbox kit of claim 1, further comprising:

a flag configured to be rotatably attached to one of the left sidewall or right sidewall, the flag positioned within the compartment formed by the roof and the floor; and a handle configured to be attached to the front door, the handle positioned within the compartment formed by the roof and the floor.

8. A method of assembling a mailbox from a mailbox kit, comprising:

providing the mailbox kit, comprising:

a roof configured to form a cover of the mailbox, the roof having an arched shape and opposing elongated roof bottom edges forming a bottom of the arched shape;

a floor configured to form a bottom of the mailbox, the floor comprising a panel having opposing elongated floor sides and corresponding opposing floor flanges extended downward from each of the floor sides, the floor positioned under the roof such that the opposing elongated floor sides are adjacent and substantially parallel to respective roof bottom edges, whereby the floor and the roof form a compartment;

a left sidewall configured to form a left sidewall of the mailbox, the left sidewall positioned within the compartment formed by the roof and the floor;

a right sidewall configured to form a right sidewall of the mailbox, the right sidewall positioned within the compartment formed by the roof and the floor;

a front door configured to form a front door of the mailbox which can be pivoted between an open position and a closed position, the front door positioned within the compartment formed by the roof and the floor; and a rear panel configured to form a rear panel of the mailbox, the rear panel positioned adjacent the floor and nested within the floor side flanges; and wherein the front door, rear panel, left sidewall and right sidewall are stacked on each other within the compartment;

attaching the left sidewall to one of the floor sides;

attaching the right sidewall to the other of the floor sides;

attaching the rear panel to the left sidewall, right sidewall and floor;

attaching the roof to the left sidewall, right sidewall and rear panel; and attaching the front door to the one of the floor or the right sidewall and left sidewall, such that the front door is pivotable between the closed position and the open position.

9. The method of claim 8, wherein the mailbox kit further comprises a flag, the flag positioned within the compartment formed by the roof and the floor; and a handle configured to be attached to the front door, the handle positioned within the compartment formed by the roof and the floor;

and wherein the method further comprises:

attaching the flag to one of the left sidewall or right sidewall such that the flag is rotatable; and attaching the handle to an outside of the front door.

10. A mailbox kit configured to be assembled into an assembled mailbox, comprising:

a roof configured to form a cover of the assembled mailbox, the roof having an arched shape and opposing elongated roof bottom edges forming a bottom of the arched shape;

a floor configured to form a bottom of the assembled mailbox, the floor comprising a panel having opposing elongated floor sides, the floor positioned under the roof such that the opposing elongated floor sides are adjacent and substantially parallel to respective roof bottom edges, whereby the floor and the roof form a compartment;

a left sidewall configured to form a left sidewall of the assembled mailbox, the left sidewall positioned within the compartment formed by the roof and the floor;

a right sidewall configured to form a right sidewall of the assembled mailbox, the right sidewall positioned within the compartment formed by the roof and the floor; and a front door configured to form a front door of the assembled mailbox which can be pivoted between an open position and a closed position, the front door positioned within the compartment formed by the roof and the floor.

11. The mailbox kit of claim 10, wherein the front door, left sidewall and right sidewall are stacked on each other within the compartment.

12. The mailbox kit of claim 10, further comprising a rear panel configured to form a rear panel of the assembled mailbox, the rear panel positioned adjacent the floor.

13. The mailbox kit of claim 12, wherein the front door, left sidewall and right sidewall are stacked on each other within the compartment.

14. The mailbox kit of claim 13, further comprising:

a flag configured to be rotatably attached to one of the left sidewall or right sidewall, the flag positioned within the compartment formed by the roof and the floor.

15. The mailbox kit of claim 14, further comprising:

a handle configured to be attached to the front door, the handle positioned within the compartment formed by the roof and the floor.

16. The mailbox kit of claim 10, further comprising:

a flag configured to be rotatably attached to one of the left sidewall or right sidewall, the flag positioned within the compartment formed by the roof and the floor; and a handle configured to be attached to the front door, the handle positioned within the compartment formed by the roof and the floor.

* * * * *